United States Patent [19]

Sowash

[11] Patent Number: 5,012,744

[45] Date of Patent: May 7, 1991

[54] SABOT BULLET

[75] Inventor: Robert P. Sowash, Santa Cruz, Calif.

[73] Assignee: Olin Corporation, Cheshire, Conn.

[21] Appl. No.: 485,680

[22] Filed: Feb. 27, 1990

Related U.S. Application Data

[63] Continuation-in-part of Ser. No. 397,363, Aug. 22, 1989, which is a continuation of Ser. No. 246,898, Sep. 16, 1988, abandoned, which is a continuation of Ser. No. 31,721, Mar. 30, 1987, abandoned.

[51] Int. Cl.[5] ..... F42B 14/06

[52] U.S. Cl. ..... 102/523; 102/439

[58] Field of Search ..... 102/439, 448, 501, 517, 102/520, 521, 522, 523

[56] References Cited

U.S. PATENT DOCUMENTS 3,726,231 4/1973 Kelly et al. ..... 102/522
4,048,922 9/1977 Buljovcic ..... 102/509

FOREIGN PATENT DOCUMENTS 347979 7/1937 Italy ..... 102/501
1041865 9/1983 Italy ..... 102/501
1068694 1/1984 U.S.S.R. ..... 102/501

*Primary Examiner*—Charles T. Jordan
*Assistant Examiner*—Richard W. Wendtland
*Attorney, Agent, or Firm*—J. R. Wahl

[57] ABSTRACT

A sabot bullet having a bullet body with an improved configuration in the area at which the two conical parts of the bullet body are joined. A connecting part is provided between the parts which extend longitudinally of the bullet body and is integral with the adjacent ends of the conical parts. In a first embodiment, the connecting part is a cylindrical connecting member integral at its ends with the conical parts. In a second embodiment, the connecting part is an annular, solid extension having a traversely concave outer surface; thus, the extension represents a gradual change in the outer surface of the bullet body from one conical part to the other conical part. An improved sabot segment has ribs on the outer surface thereof. These ribs allow the sabot segment to be compressed or to yield when the sabot bullet is fired from a gun. The ribs extend longitudinally of the sabot segments and are preferably transversely semi-circular. End bands can also be provided with the ribs.

12 Claims, 1 Drawing Sheet

FIG-1
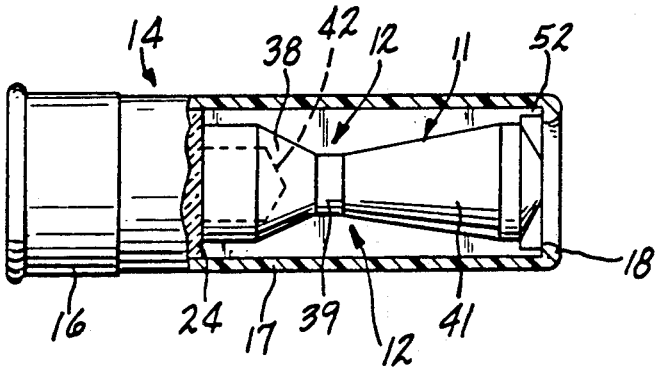
FIG-2
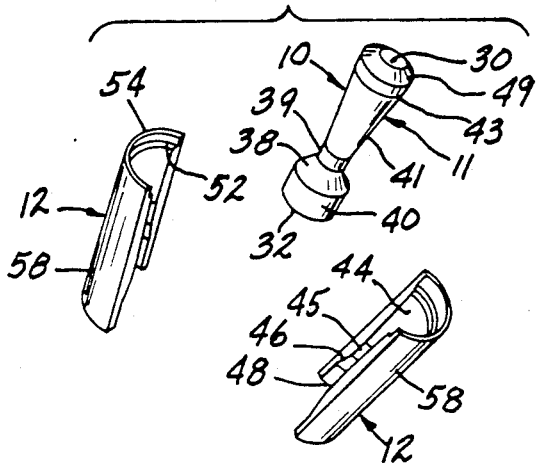
FIG-5
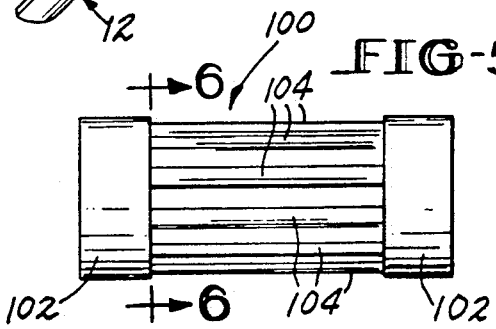
FIG-4
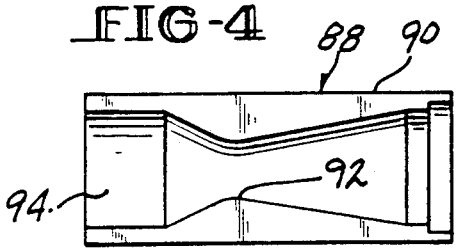
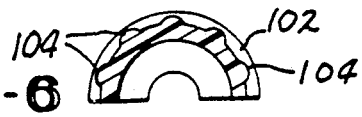
FIG-6
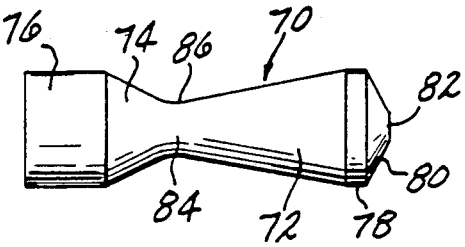
FIG-3
FIG-7
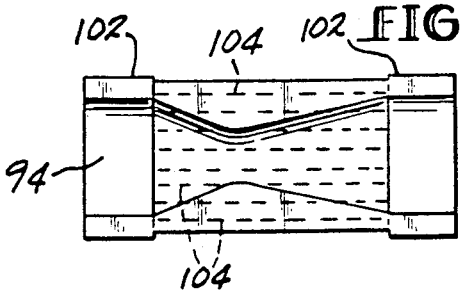

SABOT BULLET

This is a continuation-in-part of application Ser. No. 397,363, filed Aug. 22, 1989, which was a continuation of application Ser. No. 246,898, filed Sept. 16, 1988, now abandoned, which was a continuation of application Ser. No. 031,721, filed Mar. 30, 1987, now abandoned.

This invention relates to improvements in sabot bullets and, more particularly, to an improved bullet body for such a bullet.

BACKGROUND OF THE INVENTION

Sabot bullets have been known and used in the past for a number of years. A disclosure relating to such a bullet includes U.S. Pat. No. 3,726,231. In that disclosure, a sabot bullet is described in which the bullet body of the sabot bullet has two conical parts which are joined together at a junction, are integral with each other, and diverge outwardly as the parts extend away from their junction. While this construction of a sabot bullet body has been satisfactory in many instances, it has also proven to be a drawback inasmuch as the bullet body has a tendency to break at the junction. This thereby minimizes the penetration of the bullet body in a target which is struck by the bullet body after being shot from a gun. Because of this problem, a need exists for improvements in the construction of a bullet body of a sabot bullet. The present invention satisfies this need.

Other disclosures relating to bullet bodies include U.S. Pat. Nos. 3,814,019, 3,927,618, 4,005,660, 4,048,922, French patent 2,313,656, Russian patents 1041865 and 1068694, and Italian patent 347,979.

SUMMARY OF THE INVENTION

The present invention is directed to a sabot bullet having a bullet body which has an improved configuration in the area at which the two conical parts of the bullet body are joined. Instead of joining the conical parts abruptly together to each other at their junction, a means is provided between the parts which extends longitudinally of the bullet body and is integral with the adjacent ends of the conical parts. Thus, the conical parts are separated from each other and the region therebetween is strengthened to thereby minimize or eliminate any tendency for the bullet body to shear or break at the junction between the conical end parts.

Maintaining the bullet body in one piece is essential for accuracy. It also provides for greater penetration of the bullet body into a target and, when used with shotguns, is especially suitable for shotguns with full choke bores which would otherwise operate to weaken the bullet body as it leaves the barrel of the shotgun after being fired.

In a first embodiment of the bullet body, the means between the conical parts is a cylindrical connecting member integral at its ends with the conical parts. In a second embodiment of the bullet body, the means between the parts is an annular, solid extension having a transversely concave outer surface; thus, the extension represents a gradual change in the outer surface of the bullet body from one conical part to the other conical part.

The primary object of the present invention is to provide an improved sabot bullet in which the body of the sabot bullet is strengthened at the region of smallest diameter to thereby minimize or substantially eliminate the problems due to breaking of the bullet body in such region, all of which is accomplished without effecting its aerodynamic and target-penetration capabilities.

A further aspect of the present invention is the improved sabot segments of the sabot bullet of the present invention such segments have ribs on the outer surface thereof. These ribs allow the sabot segments to be compressed or to yield when the sabot bullet is fired from a gun. For example, the sabot bullet may be made of a gun barrel gauge of 0.300 but the bullet may be fired from a gun having a barrel gauge of 0.270 because the ribs would yield inwardly and allow the sabot bullet to pass through the barrel of smaller gauge even though the sabot bullet is designed for the barrel of larger gauge. The ribs extend longitudinally of the sabot segments and are preferably transversely semi-circular. End bands can also be provided with the ribs.

Another object of the present invention is to provide improved sabot segments for a sabot bullet wherein such segments have yieldable ribs to accommodate the sabot bullet for gun barrels of different gauges.

Other objects of the present invention will become apparent as the following specification progresses, referenced being had to the accompanied drawings for an illustration of the invention.

BRIEF DESCRIPTION OF THE DRAWINGS

FIG. 1 is a side elevational view of a conventional shotgun shell having a first embodiment of the improved sabot bullet of the present invention mounted therein;

FIG. 2 is an exploded, perspective view of the sabot bullet showing the bullet body and the sabot segments separated from each other;

FIG. 3 is a cross-sectional view of a second embodiment of the bullet body of the present invention;

FIG. 4 is an elevation view of a sabot segment for the bullet body of FIG. 3;

FIG. 5 is a side elevational view of an improved sabot segment with external ribs;

FIG. 6 is a cross-sectional view taken along lines 6—6 of FIG. 5; and FIG. 7 is a view similar to FIG. 4 but showing the inner surface of sabot segments of FIGS. 5 and 6.

DETAIL DESCRIPTION OF THE DRAWINGS

The present invention provides, in a first embodiment, a sabot bullet 10 (FIG. 2) having a bullet body 11 and a pair of sabot segments 12. The segments 12 are adapted to embrace and thereby enclose bullet body 11 in a shell-like manner shown in FIG. 1. The bullet, when so assembled, is adapted to be placed in a conventional shotgun shell 14 (FIG. 1).

Shell 14 includes a cylindrical base 16 and a tubular body 17 terminating at its forward end with an inwardly crimped curl 18 which holds the bullet 10 in the tubular body 17. Bullet 10 is forwardly of the wad 24 of shell 14. The wad transfers the force of the explosive charge of shell 14 to bullet 10, causing it to be projected forwardly and out of tubular body 17 and into the air along a specific trajectory. The length of sabot bullet 10 is such that body 11 and sabot segments 12 extend between the forward, flat face of wad 24 and the curl 18 as shown in FIG. 1.

Body 11 of sabot bullet 10 is of one-piece construction and has a front, circular, flat end face 30 and a base 32 having an outer surface portion 40 of cylindrical shape (FIG. 2). Body 11 further includes a first conical part 38 having a conical outer surface which converges to a cylindrical central part 39 at one end of a second conical member 41 having a conical outer surface. Member 41 extends to a cylindrical part 43 at the end of a third conical part 49 opposite to the end corresponding to end face 30.

The center of gravity of the body 11 is positioned forwardly of the center of geometric mass thereof. Preferably, the rear end portion of the bullet is hollow, and a plug 42 of suitable material is inserted in the hollow end of the body. Such a plug can be of plastic, wood, metal, or other material.

Each of sabot segments 12 extends about bullet body 11 for about one-half the circumference of the bullet body. Both sabot segments 12 have semi-cylindrical outer surfaces which mate to present a full cylindrical outer surface for sabot bullet 10. This full cylindrical outer surface snugly fits within the cylindrical inner surface of shell 17 (FIG. 1).

The inner surface of each of the segments matches and is complimentary to the adjacent outer surface portions of bullet body 11 as shown in FIG. 1. To this end, each sabot segment 12 has a forward tapered surface portion 44 for mating with second conical part 41 of body 11, a cylindrical surface portion 45 for mating with cylindrical surface 39 of body 11, a conical surface 46 for mating with the outer surface of first conical part 38, and cylindrical surface 48 for mating with a cylindrical surface portion 40 of base 32.

The forward end portions of segments 12 are provided with shoulders 52, thus radially spacing the front end 54 of each segment 12 from the frusto-conical nose part 45 of bullet body 11.

In use, conical bullet 10 is placed in shell 14 and the shell is placed in a shotgun. When the shell is fired, bullet 10 leaves shell 17, causing the sabot segments 12 to spread apart and to separate from bullet body 11 in flight. The bullet body then continues by itself toward the target.

The cylindrical part 39 of bullet body 11 provides an improvement over prior art sabot bullets because part 39 provides for a stronger construction for body 11 and minimizes the tendency for the body to break at is narrowest portion, a result which has occurred all too often when conventional sabot bullet bodies are used. The construction of the body 11 provides that sabot bullet 10 is more suitable for shotguns having a full choke or open bores.

A second, preferred embodiment of the bullet body of the present invention is shown in FIG. 3 and is broadly denoted by the numeral 70. Bullet body 70 includes a conical front part 72, a conical rear part 74 and a cylindrical base part 76 integral with part 74. Front conical part 72 has a cylindrical portion 78 on the front end thereof and a shallow conical part 80 having a flat end face 82 is integral with part 78.

Conical parts 72 and 74 are interconnected by an annular part 84 which is integral with parts 72 and 74 and which has an annular, transversely concave outer surface portion 86 (FIG. 3) which merges smoothly with the adjacent ends of conical parts 72 and 74. Part 84 thereby provides a strong connection between parts 72 and 74 which is not easily sheared off or broken because there is no abrupt surface discontinuities on parts 72, 74 and 84 as there are in the prior art bullet body shown in U.S. Pat. No. 3,726,231.

A pair of sabot segments are associated with bullet body 70 in the same manner as sabot segments 12 are associated with bullet body 11 in FIGS. 1 and 2. Each sabot segment 88 has an outer cylindrical surface 90 and inner surface portions complemental to the adjacent outer surface portions of bullet body 70. Thus, the two sabot segments 88 on the bullet body 70 will embrace the bullet body in the same manner as shown in FIG. 1 with respect to bullet body 11 in sabot segments 12.

Each sabot segment 88 has a semi-circular projection 92 which is transversely convex so as to mate with the concave inner surface 86 of extension 84 on bullet body 70 (FIG. 3). Thus, the bullet body 70 fits snugly in the recesses 94 defined by the inner surface portions of respective sabot segments 88. The rounded, concave outer surface of extension 84 (FIG. 3) provides a strong attachment for conical parts 72 and 74. Thus, this strong connection will avoid breakage due to shearing off of the conical parts 72 and 74 (FIG. 3) one from the other, and will maintain the structural integrity of the bullet body 70 as the bullet body is fired from a gun and travels through the air and strikes a target.

An improved sabot segment of resilient plastic material, such as Delrin, is shown in FIGS. 5–7 and is broadly denoted by the numeral 100. Segment 100 has inner surface portions such as the surface portions shown in FIG. 4 for mating with the outer surface of one-half of the bullet body 70. The sabot segment 100 has a pair of semi-circular end bands 102 which are at the ends of the segment and which have a radius slightly greater than the radius of the major portion of the outer surface of the body of the sabot segment 100 itself. Moreover, the sabot segment has a number of longitudinal ribs 104 integral with the main body of the sabot segment 100, and the ribs 104 extend between bands 102 as shown in FIGS. 5 and 7. The ribs 104 are transversely semi-cylindrical as shown in FIG. 6.

The purpose of bands 102 and ribs 104 is to permit yielding of these bands and ribs in the event that the sabot bullet is used with a gun which has a bore size or gauge which is slightly smaller than the bore size with which the sabot bullet is initially designed to be used. For instance, if the sabot bullet made from bullet body and sabot segments 100 is designed for a gun having a barrel of 0.300 gauge, the sabot bullet can be used with a gun having a 0.270 gauge barrel because the bands 102 and ribs 104 will yield and compress to allow movement of the sabot bullet through and out of the barrel without damage to the bullet or to the barrel itself.

I claim:

1. A sabot bullet comprising:

a bullet body having a pair of axially aligned conical parts adjacent to and spaced apart from each other, each conical part increasing in diameter as the conical part extends away from the other conical part, there being means extending longitudinally of the bullet body for separating and interconnecting the conical parts, said connecting means including an annular connecting part having a rounded outer surface portion which merges smoothly with the outer surface portions of the adjacent ends of the conical parts; and a number of sabot segments engaging and forming a shell in surrounding relationship to the bullet body, each sabot segment having inner surface portions substantially complementary to the adjacent outer surface portions of the bullet body.

2. A sabot bullet as set forth in claim 1, wherein said connecting part has a transversely concave outer surface.

3. A sabot bullet as set forth in claim 2, wherein said connecting part is annular and solid and integral with the conical parts.

4. In a sabot bullet:

a bullet body having a pair of axially aligned conical parts adjacent to and spaced from each other, each conical part increasing in diameter as the conical part extends away from the other conical part, there being a connecting part extending longitudinally of the bullet body for separating and interconnecting the conical parts, said connecting part having an outer surface merging smoothly with the outer surface portions of the adjacent ends of the conical parts.

5. In a sabot bullet as set forth in claim 4, wherein said connecting part is annular.

6. In a sabot bullet as set forth in claim 4, wherein said connecting part has a transversely concave outer surface.

7. In a sabot bullet of the type having a bullet body:

a sabot segment having an inner surface for removably engaging and forming a partial shell for partially surrounding the bullet body, said sabot segment having an outer surface provided with a rib thereon for yielding inwardly.

8. In a sabot bullet as set forth in claim 7, wherein said rib extends longitudinally of the segment.

9. In a sabot bullet as set forth in claim 7, wherein is included a pair of parallel ribs extending longitudinally of the segment at the outer surface thereof.

10. In a sabot bullet as set forth in claim 7, wherein said segment has a pair of semi-circular bands integral with the segment at the ends thereof.

11. In a sabot bullet as set forth in claim 7, wherein is included a number of ribs extending between the bands along the outer surface of the segment.

12. In a sabot bullet as set forth in claim 7, wherein said material of the segment is yieldable plastic.

* * * * *